United States Patent [19]

Coryell

[11] 4,128,192

[45] Dec. 5, 1978

[54] THROW-AWAY CAN WITH INTEGRAL CLOSURE AND PULL-UP SPOUT

[75] Inventor: Stanley W. Coryell, Arlington, Tex.

[73] Assignee: Classic Chemical, Grand Prairie, Tex.

[21] Appl. No.: 804,571

[22] Filed: Jun. 8, 1977

[51] Int. Cl.[2] ..... B65D 47/28

[52] U.S. Cl. ..... 222/525; 222/541; 222/570

[58] Field of Search ..... 222/541, 526, 527, 537, 222/522, 523, 525, 543, 563, 566, 569, 570, 562; 220/85 SP, 265, 266

[56] References Cited

U.S. PATENT DOCUMENTS

| | | | |
|---|---|---|---|
| 2,545,178 | 3/1951 | Vaughn | 222/541 |
| 3,628,705 | 12/1971 | Rieke | 222/527 |
| 3,744,662 | 7/1973 | Zundel | 222/543 |

FOREIGN PATENT DOCUMENTS

| | | | |
|---|---|---|---|
| 2161226 | 6/1972 | Fed. Rep. of Germany | 220/85 SP |
| 1194634 | 11/1959 | France | 222/522 |
| 1562177 | 2/1969 | France | 222/541 |

*Primary Examiner*—Stanley H. Tollberg
*Assistant Examiner*—H. Grant Skaggs
*Attorney, Agent, or Firm*—Paul & Paul

[57] ABSTRACT

A throw-away one-time can or container for liquid additives for motor vehicle fuel tanks and the like has a puncturable membrane and a one-piece snap-in closure and pull-up spout. In the before-use unopened condition of the can, the integral spout extends downwardly from the closure into the can for almost the full depth of the can. When the contents of the can are to be poured into the fuel tank, the snapped-in closure is dislodged from the nozzle in the can top by pulling up on a pull-up ring. Further pull on the ring pulls the spout up to its fully extended pouring position. The exterior wall of the spout is tapered slightly, being of larger diameter at its lower end so as to provide a leak-tight closing of the nozzle in the can top.

3 Claims, 8 Drawing Figures

THROW-AWAY CAN WITH INTEGRAL CLOSURE AND PULL-UP SPOUT

BACKGROUND OF THE INVENTION

Various models of automobiles are equipped with a fuel tank which has a filler pipe which extends upwardly from the tank along a slight inclined path toward the rear of the automobile, and then bends upwardly at a somewhat greater incline, terminating at a capped end located behind the license plate holder which is pivotal at its upper edge and serves as a door to give access to the filler pipe. Within the filler pipe, spaced from the cap end, is a hinged baffle or gate provided to prevent siphoning of gas out of the tank, and also to prevent the escape of fuel and fumes. This baffle or gate is opened by the nozzle of the gas supply hose when it is inserted by the attendant into the end of the filler pipe. It will be seen that an automobile fuel tank and filler pipe of the type just described presents a problem when an individual owner or a gas station attendant wants to add the contents of a quart can of additive into the fuel tank.

The same or similar problem is presented in automobiles in which the filler pipe extends from the gas tank out the side of the car. In such cars, the portion of the filler pipe containing the baffle is horizontal, or nearly so, for the first several inches from the cap end.

SUMMARY OF THE INVENTION

A principal object of the present invention is to provide a can or a container for fuel tank additives intended for one-time throw-away use and provided with an interior spout which may be pulled out by the owner or gas station attendant and inserted into the end of the filler pipe to facilitate pouring the contents of the can into the tank.

A further object is to provide a can of the foregoing type in which the spout is an integral part of a snap-in closure adapted to be snapped into and snapped out of the opening or nozzle in the can top or trimming.

Another object is to provide a can of the foregoing type in which the integral spout is long enough to push open the baffle gate inside the filler pipe.

While the foregoing objects are directed to a can or container for fuel tank additives, the spout can of the present application is also useful for adding transmission additives and other type additives, as well as for other purposes.

DETAILED DESCRIPTION OF THE PREFERRED EMBODIMENTS

Figure 1:
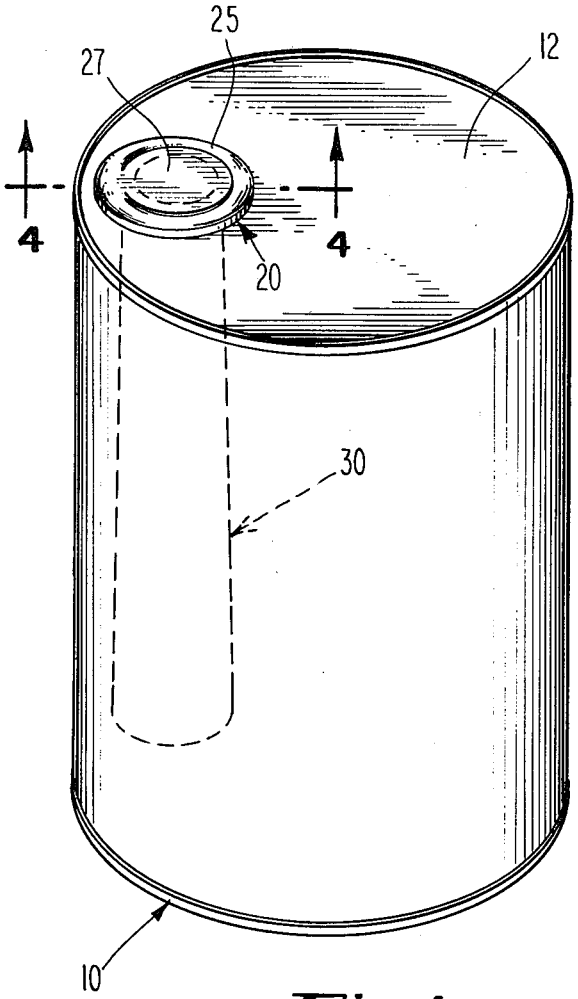
FIG. 1 is a perspective view of a can embodying the present invention showing the integral closure and spout in unopened position.

Referring now to the drawing, there is shown a cylindrical can or container 10, of metal, plastic, cardboard or other suitable material having a top or trimming 12, usually metal, having therein a circular nozzle 14 offset from the center of the can and located close to one edge of the trimming 12. The peripheral edge of nozzle 14 is provided with an upstanding lip or flange 15 as seen best in FIGS. 2,4,7 and 8.

Figure 2:
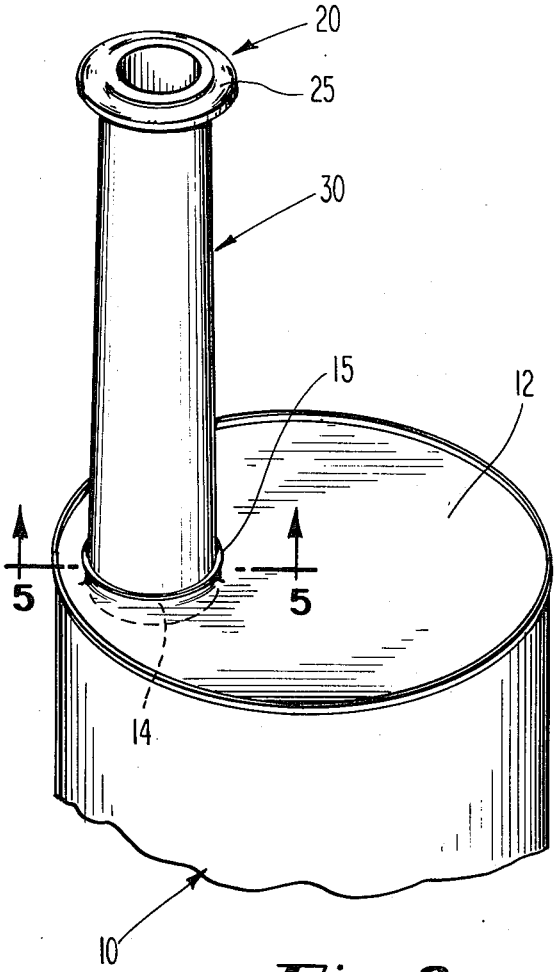
FIG. 2 is a perspective view, broken away, showing the integral closure and spout in opened pulled-up position.

A closure 20 is pressed, as by snap-in action, into the nozzle 14. Closure 20 is a molded plastic item and has, as an integral part thereof, an elongated depending spout 30 which extends downwardly into the can 10 for almost the full depth of the can, as best seen in FIG. 2.

Closure 20 has a plug portion having a lower annular wedge surface 21 and an upper annular reverse wedge surface 22. When the closure 20 is pressed into the circular opening of nozzle 14, the lower wedge surface 21 cams the lip or flange 15 outwardly to allow passage of the plug portion. Thereafter, the upstanding lip 15 is received into a recess 23 located just above the reverse wedge surface 22, and this reverse wedge surface serves to retain lip 15 in the recess, as illustrated in FIG. 4.

Closure 20 has a larger diameter portion which forms a shoulder 24 which supports a pull ring 25. At one side of the closure 20, the left side as viewed in FIGS. 1–5, pull ring 25 is integral with shoulder 24 and also with the smaller diameter upstanding portion 26 of the closure. For the remainder of the closure, the pull ring 25 is severed from, and is separate from, the portions 26 and 24 of the closure.

The center portion of closure 20 is closed by a solid disc or membrane 27 which is concentric within the pull ring 25.

Figure 3:
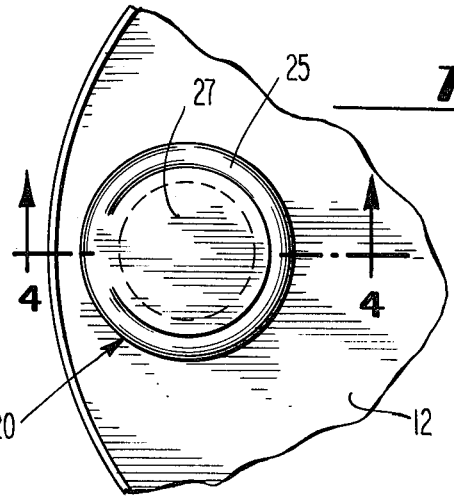
FIG. 3 is a plan view of a portion of the top of the can showing the closure and the pull-up ring.
Figure 4:
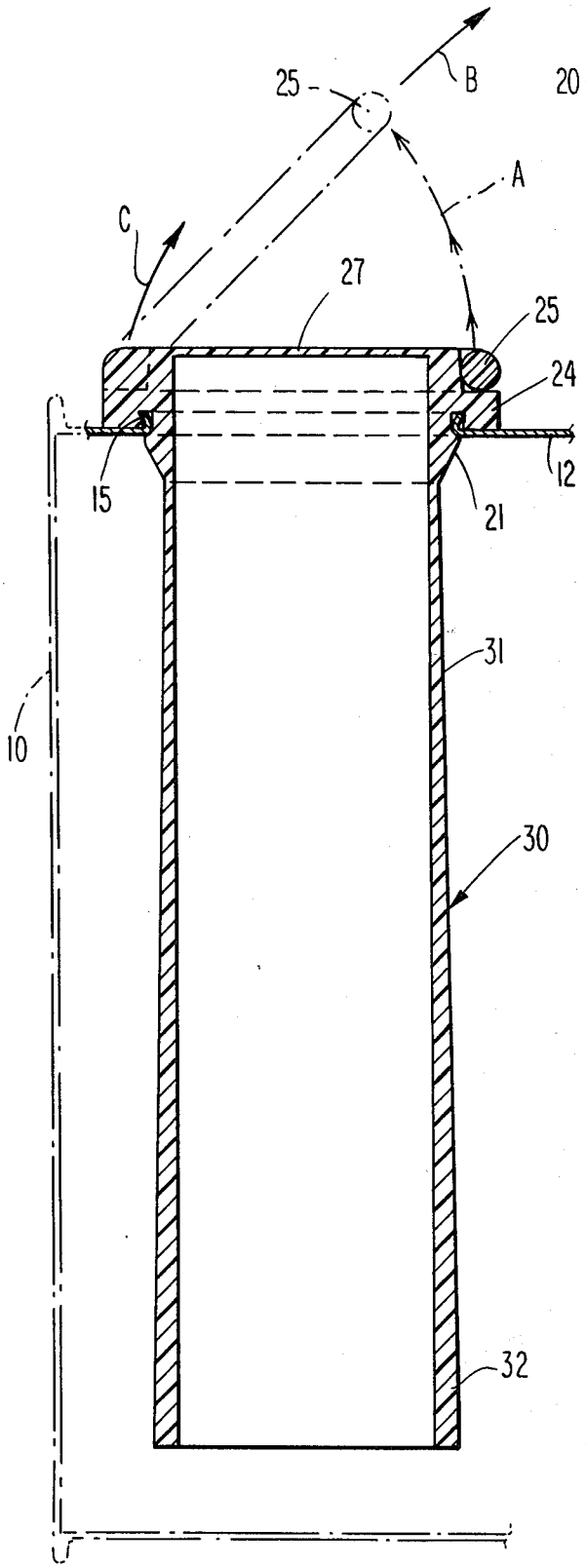
FIG. 4 is an elevational view, in section, looking laterally along the line 4—4 of FIG. 1.
Figure 5:
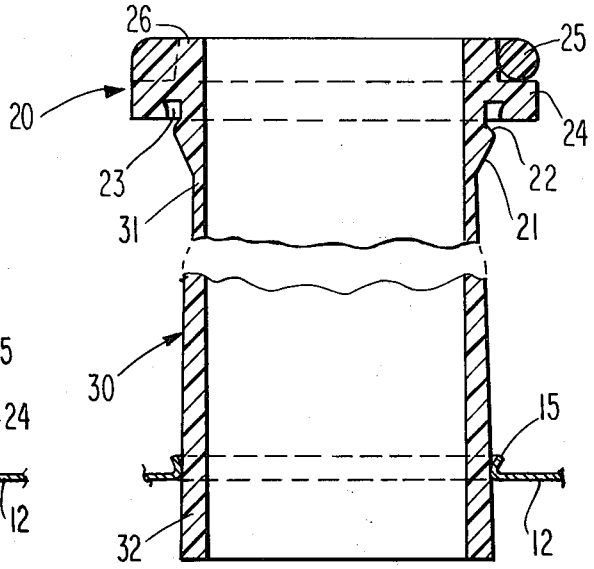
FIG. 5 is an elevational view, broken, and in section, looking laterally along the line 5—5 of FIG. 2.

When it is desired to empty the contents of the can into the fuel tank of the automobile, the plastic membrane 27 is punctured, as by a screwdriver or other suitable piercing tool, and pull ring 25 is used to dislodge closure 20 from its snapped-in closed position, illustrated in FIGS. 1, 3 and 4, and to pull it and spout 30 to an upper position illustrated in FIGS. 2 and 5. To dislodge closure 20, the pull ring 25 is first pulled angularly upwardly along an arcuate line, indicated by the arrows A in FIG. 4. This puts the pull ring 25 in the angular position illustrated in phantom in FIG. 4. The ring 25 is then pulled angularly upwardly in the direction indicated by arrow B with sufficient force to pull the one side, the left side as viewed in FIG. 4, upwardly in the direction of the arrow C. In this action, the reverse wedge surface 22 cams the lip 15 slightly outwardly, allowing the one side (the left side) to snap out of the nozzle 14. The pull ring 25 is then pulled straight up to fully dislodge the closure 20. After closure 20 has been dislodged, a continued straight upward pull on pull ring 25 pulls up the spout 30 to its fully extended pouring position, as is illustrated in FIG. 2. The spout 30 is preferably formed of semi-rigid plastic material, such as polyethylene, and its wall preferably has a tapered thickness, with the smaller outside diameter being at the upper end 31 and the larger outside diameter at the lower end 32. The smaller outside diameter of spout 30 is smaller than the diameter of nozzle 14 while the larger outside diameter of spout 30 is larger than the diameter of nozzle 14. Thus, when spout 30 is pulled up to its fully extended position, its lower end 32 effectively closes and seals the circular opening of nozzle 14.

Figure 6:
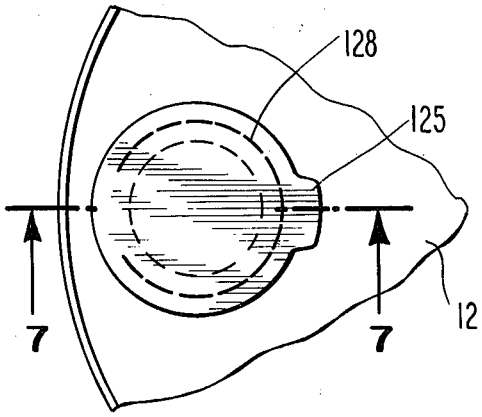
FIG. 6 is a plan view of a portion of the upper surface of the can showing a modified form of closure and pull-up ring.
Figure 7:
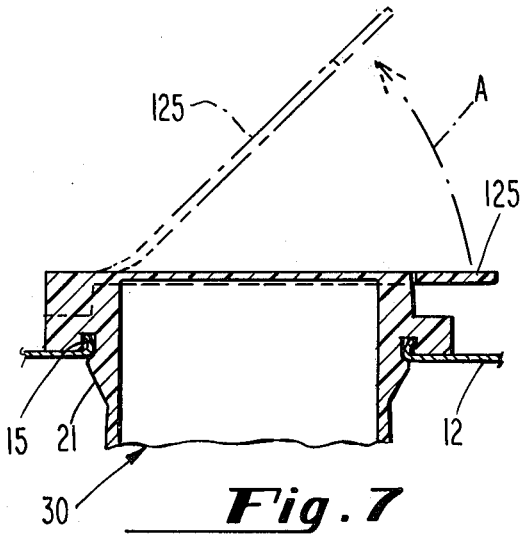
FIG. 7 is a perspective view, broken, and in section, looking along the line 7—7 of FIG. 6.

FIGS. 6 and 7 show a modification of the closure 20, and specifically a modification of the pull-up ring. In the modification of FIG. 6 and 7, pull ring 125, instead of being completely severed from the flange portion 24 and upstanding portion 26 of closure 20 for most of its annular length, is connected thereto by a score line 128. When the contents of the can are to be used, the attendant pulls up the pull ring 125 by grasping it at the tab and pulling upwardly in the direction of the arrow A in FIG. 7, thereby to tear away the ring 125 from the closure body at the score line 128. In other respects, the closure of FIGS. 6 and 7 is similar to that of FIGS. 1–5.

Figure 8:
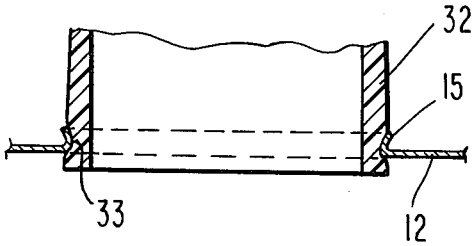
FIG. 8 is an elevational view, broken and in section, of the lower end of a modified spout when in fully pulled-up position.

FIG. 8 shows a slight modification of spout 30. In FIG. 8 the lower end portion 32 of spout 30 is provided with an annular recess 33 for receiving the peripheral rim 15 of the nozzle 14. Thus, when closure 20 and integral spout 30 are pulled upwardly by the pull ring, the lip 15 will slide on the tapered wall of the spout 30 until the lip 15 arrives at the recess 33.

It will be seen that the present invention provides a throw-away one-time can or container having an integral closure and spout of molded semi-rigid plastic. After puncturing the membrane of the closure by a piercing tool, the pull-up ring, which is an integral part of the closure, is pulled upwardly to dislodge the closure and to thereafter pull the spout up to its fully extended pouring position.

While the top or trimming 12 will usually be metal, it could be made of plastic.

While a cylindrical can has been illustrated, the can or container may be rectangular or any other suitable shape.

While the contents of the can or container of the present invention will ordinarily be liquid, the can may also be used for non-liquid products, such as pellets.

The nozzle in the container top, and hence the integral closure and spout assembly, are preferably located to one side of center to facilitate pouring of the contents.

While the container has been described for use in pouring an additive into the fuel tank of a motor vehicle, the new container may, of course, be used for other purposes.

What is claimed is

1. A throw-away one-time can for liquid additives for motor-vehicle fuel tanks and the like has a body having a top which includes a circular opening having an upstanding peripheral lip for receiving a circular cross-section closure element adapted to snap removably into said opening, said closure element including a depending integral spout which extends almost to the bottom of said can, said closure element and depending spout comprising:

a. an annular plug portion on the underside of said closure element, said plug portion having a lower annular downwardly-inwardly inclined surface and an upper annular upwardly-inwardly inclined surface, the maximum outside diameter of said plug portion being somewhat larger than the diameter of said opening in said can top;

b. an enlarged-diameter portion above and integral with said plug portion, the outer portions adapted to rest on said can top when said closure element is snapped into position, said enlarged-diameter portion having an annular recess which extends upwardly just above said upwardly-inwardly inclined surface for receiving and closely confining the upstanding peripheral lip of said top opening when said closure element is snapped into position with said spout extending downwardly through said top opening;

c. a pull-up ring above and concentric with said enlarged-diameter portion, said pull-up ring being integrally connected with one side only of said enlarged-diameter portion and adapted, in response to an upward pull applied to said ring, to lift initially said one side only of the enlarged-diameter portion, thereby to open said confining recess and allow said upwardly-inwardly inclined surface to cam said lip radially outwardly, whereby a continued or subsequent upward pull on said ring removes said closure element from its snapped-in position;

d. said spout being a hollow cylindrical body integral with and depending from said annular lower inclined surface of said plug portion.

2. A container according to claim 1 wherein:

a. said closure element includes a solid puncturable disc membrane.

3. A container according to claim 1 wherein:

a. said nozzle is located off the center of said container top close to one edge thereof.

* * * * *